US008515298B2

(12) United States Patent
Miyahara et al.

(10) Patent No.: US 8,515,298 B2
(45) Date of Patent: Aug. 20, 2013

(54) ROTATION SPEED CONTROL FOR AN IMAGE FORMING APPARATUS FAN

(75) Inventors: Kensuke Miyahara, Hekinan (JP); Katsuyuki Yokoi, Iwakura (JP); Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 972 days.

(21) Appl. No.: 12/546,184

(22) Filed: Aug. 24, 2009

(65) Prior Publication Data

US 2010/0054771 A1 Mar. 4, 2010

(30) Foreign Application Priority Data

Aug. 28, 2008 (JP) ..... 2008-219849

(51) Int. Cl.
*G03G 15/00* (2006.01)

(52) U.S. Cl.
USPC ..... 399/44; 399/91; 399/92; 399/94; 399/97; 399/390

(58) Field of Classification Search
USPC ..... 399/44, 91, 94, 97, 390
See application file for complete search history.

(56) References Cited

U.S. PATENT DOCUMENTS

| | | | | |
|---|---|---|---|---|
| 4,652,110 | A * | 3/1987 | Sato et al. | 399/406 |
| 5,202,729 | A * | 4/1993 | Miyamoto et al. | 399/103 |
| 5,920,759 | A * | 7/1999 | Ushiroji et al. | 399/406 |
| 6,219,497 | B1 * | 4/2001 | Hauman et al. | 399/44 |
| 6,389,247 | B1 * | 5/2002 | Chung | 399/69 |
| 6,477,339 | B1 * | 11/2002 | Yano et al. | 399/66 |
| 6,934,486 | B2 * | 8/2005 | Lee | 399/92 |
| 7,110,685 | B2 * | 9/2006 | Shin | 399/44 |
| 7,120,367 | B2 * | 10/2006 | Kyung et al. | 399/44 |
| 7,206,533 | B2 * | 4/2007 | Kwon | 399/92 |
| 7,269,374 | B2 * | 9/2007 | Oka | 399/94 |
| 7,315,721 | B2 * | 1/2008 | Kitayama | 399/320 |
| 7,421,237 | B2 * | 9/2008 | Funato et al. | 399/341 |
| 7,433,623 | B2 | 10/2008 | Nakamura et al. | |
| 7,466,934 | B2 * | 12/2008 | Chae et al. | 399/69 |
| 7,549,629 | B2 * | 6/2009 | Tateishi et al. | 271/98 |
| 7,627,259 | B2 * | 12/2009 | Chung et al. | 399/44 |
| 7,712,318 | B2 * | 5/2010 | Iwasaki | 62/3.7 |
| 8,086,130 | B2 * | 12/2011 | Furukawa | 399/92 |

(Continued)

FOREIGN PATENT DOCUMENTS

| | | |
|---|---|---|
| JP | 02-027368 | 1/1990 |
| JP | 07-239647 | 9/1995 |

(Continued)

*Primary Examiner* — David Gray
*Assistant Examiner* — Geoffrey Evans
(74) *Attorney, Agent, or Firm* — Banner & Witcoff, Ltd.

(57) ABSTRACT

An electrophotographic image forming apparatus is provided. The image forming apparatus includes an image forming unit configured to form an image on a recording medium; a fixing unit configured to fix the image onto the recording medium by applying heat and pressure; a re-transport unit configured to re-transport the recording medium which has passed through the fixing unit, to the image forming unit along a re-transport path; a cooling unit provided between the fixing unit and the image forming unit along the re-transport path and configured to cool the recording medium transported by the re-transport unit; a parameter signal output unit configured to output a signal corresponding to a parameter for controlling the cooling unit; and a controller configured to control the cooling unit according to the signal output from the parameter signal output unit.

8 Claims, 6 Drawing Sheets

(56) References Cited

U.S. PATENT DOCUMENTS

| | | | | |
|---|---|---|---|---|
| 8,086,131 | B2 * | 12/2011 | Koshida | 399/92 |
| 2006/0083535 | A1 * | 4/2006 | Shepherd et al. | 399/92 |
| 2006/0093420 | A1 * | 5/2006 | Oba | 399/405 |
| 2006/0127119 | A1 * | 6/2006 | Sato | 399/69 |
| 2006/0222391 | A1 * | 10/2006 | Choi | 399/66 |
| 2006/0291894 | A1 * | 12/2006 | Chung et al. | 399/92 |
| 2007/0053731 | A1 * | 3/2007 | Mori et al. | 399/341 |
| 2007/0267803 | A1 * | 11/2007 | Tateishi et al. | 271/98 |
| 2008/0069607 | A1 * | 3/2008 | Otani | 399/308 |
| 2011/0026964 | A1 * | 2/2011 | Yasumoto | 399/94 |

FOREIGN PATENT DOCUMENTS

| | | |
|---|---|---|
| JP | 2000-187417 | 7/2000 |
| JP | 2003-307959 | 10/2003 |
| JP | 2006-106668 | 4/2006 |
| JP | 2006-330377 | 12/2006 |
| JP | 2007-058077 | 3/2007 |
| JP | 2007-155855 | 6/2007 |
| JP | 2007-253480 | 10/2007 |

* cited by examiner

ROTATION SPEED CONTROL FOR AN IMAGE FORMING APPARATUS FAN

CROSS-REFERENCE TO RELATED APPLICATION

This application claims priority from Japanese Patent Application No. 2008-219849, filed on Aug. 28, 2008, the entire subject matter of which is incorporated herein by reference.

TECHNICAL FIELD

Aspects of the present invention relate to an electrophotographic image forming apparatus which is capable of forming an image on a recording medium, on which an image has been formed and thermally fixed previously.

BACKGROUND

An electrophotographic image forming apparatus forms an image by electrophotography which applies a transfer current to a recording medium, such as a sheet, to attach a recording material to the recording medium. In this type of image forming apparatus, the image formed on the recording medium is thermally fixed. For example, if the recording material is toner, the toner is fused and then fixed onto the recording medium thermally so as to make the image stable.

Further, in this type of image forming apparatus, while an image is thermally fixed to the recording medium, water is evaporated from the recording medium, so that the recording medium is dried. As a result, the heat capacity of the recording medium becomes lower. If the heat capacity of the recording medium is excessively small, a large amount of toner is fused and fixed when an image is formed on a second surface in a double-side printing operation. Accordingly, in order to prevent a large amount of toner from being fused and fixed, a related-art image forming apparatus is provided with a fan for blowing cooling air to a recording medium having an image fixed thereon when humidity is equal to or less than a predetermined value.

The drying of the recording medium further affects an electric resistance value of the recording medium. If a transfer current applied to the recording medium is used to form an image by electrophotography, the electric resistance value of the recording medium greatly affects the formation of an image. Therefore, if the electric resistance value of the recording medium is increased by the evaporation of water, it may be preferable to blow cooling air in order to prevent the recording medium from being dried, as described above.

However, the heat capacity of a recording medium is not necessarily in one-to-one correspondence with the electric resistance value of the recording medium. For example, when the humidity is high and the temperature is low, the recording medium has a large electric resistance value. In this situation, if an image is formed on a second surface without blowing cooling air, the electric resistance value of the recording medium is further increased by the thermal fixation of the image on a first surface, so that it is difficult to form a high-quality image on the second surface.

SUMMARY

Accordingly, it is an aspect of the present invention to provide an electrographic image forming apparatus which applies a transfer current to a recording medium to form a first image on a first surface of a recording medium, thermally fixes the first image onto the recording medium, forming a second image on a second surface of the recording medium having the first image thermally fixed thereto, and effectively reduce or prevent a variation in the electric resistance value of the recording medium to form a high-quality image on the second surface of the recording medium.

According to an exemplary embodiment of the present invention, there is provided an electrophotographic image forming apparatus comprising: an image forming unit configured to form an image on a recording medium; a fixing unit configured to fix the image onto the recording medium by applying heat and pressure; a re-transport unit configured to re-transport the recording medium which has passed through the fixing unit, to the image forming unit along a re-transport path; a cooling unit provided between the fixing unit and the image forming unit along the re-transport path and configured to cool the recording medium transported by the re-transport unit; a parameter signal output unit configured to output a signal corresponding to a parameter for controlling the cooling unit; and a controller configured to control the cooling unit according to the signal output from the parameter signal output unit.

According to an exemplary embodiment of the present invention, there is provided an image forming apparatus comprising: an image forming unit configured to form an image on a recording medium; a fan configured to generate blowing air toward the recording medium; a temperature sensor configured to measure a temperature; a humidity sensor configured to measure a humidity; and a controller which controls the fan according to the temperature measured by the temperature sensor and the humidity measured by the humidity sensor.

According to an exemplary embodiment of the present invention, there is provided an image forming apparatus comprising: an image forming unit configured to form an image on a recording medium; a resistance measuring unit configured to measure an electric resistance of the recording medium; and a controller which controls the image forming unit based on the electric resistance of the recording medium.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Figure 1:
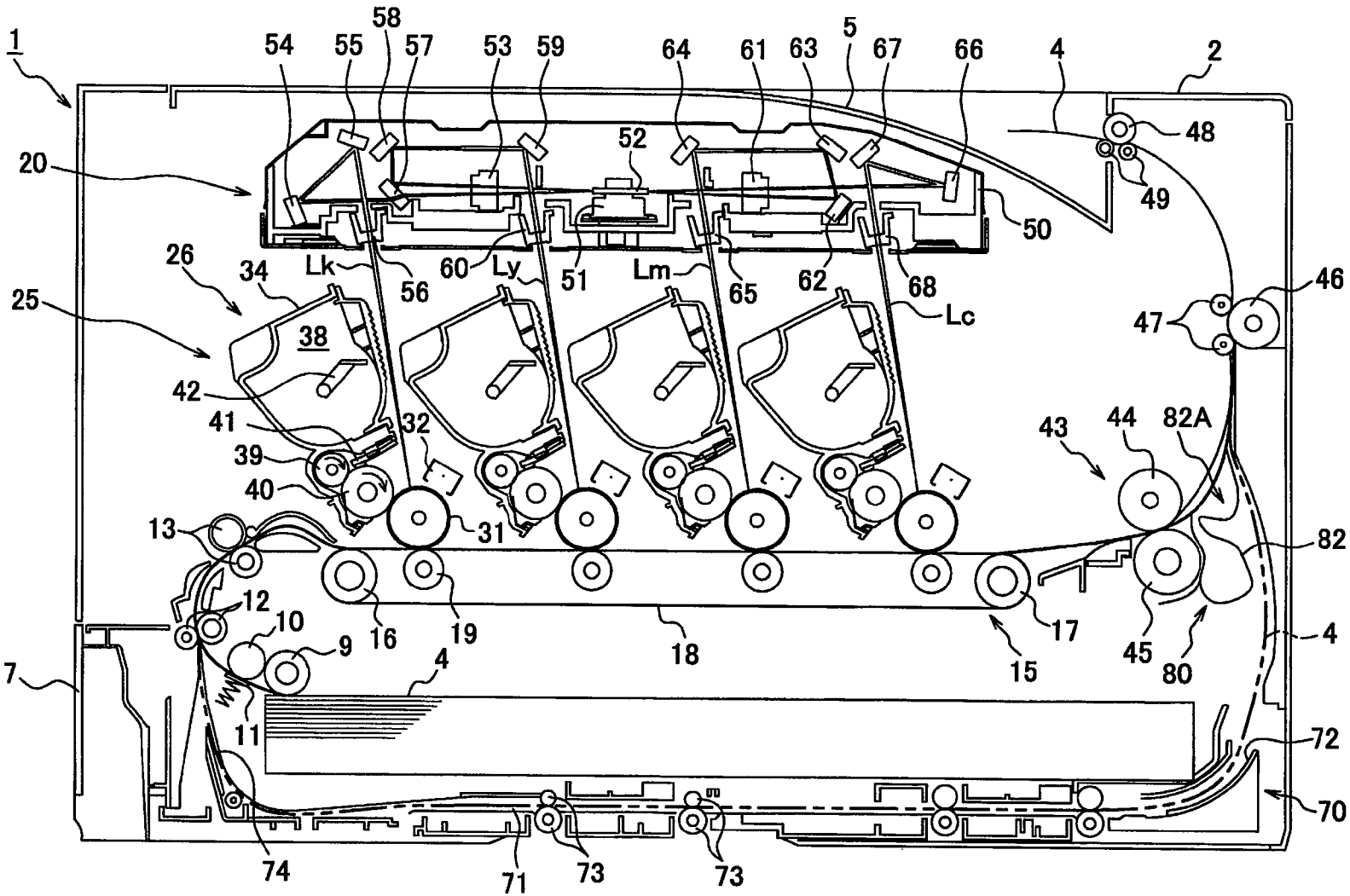
FIG. 1 is a longitudinal cross-sectional view schematically illustrating the configuration of a laser printer according to an exemplary embodiment of the present invention.

Hereinafter, exemplary embodiments of the present invention will be described with reference to the accompanying drawings. FIG. 1 is a longitudinal cross-sectional view schematically illustrating the configuration of a laser printer 1 (an example of an image forming apparatus). In the following description, the left side of FIG. 1 corresponds to a front side of the laser printer 1.

(Overall Configuration of Laser Printer)

The laser printer 1 is a direct transfer tandem color laser printer. As shown in FIG. 1, the laser printer 1 includes a substantially box-shaped body casing 2. The body casing 2 has a sheet discharge tray 5 at an upper surface thereof. A sheet (recording medium) 4 having an image formed thereon is loaded on the sheet discharge tray 5. A sheet feed cassette 7 (an example of a medium accommodating unit) is provided at a lower part of the body casing 2 such that it can be drawn out forward. The sheet feed cassette 7 accommodates the sheet 4 for forming an image. A feed roller 9 which transports the sheet 4 is provided above the front end of the feed cassette 7. A separation roller 10 and a separation pad 11 are provided on the downstream side in a direction in which the sheet is fed by the feed roller 9 and separate the sheets 4 fed by the feed roller 9 one by one.

The uppermost sheet 4 in the sheet feed cassette 7 is pressed against the feed roller 9 by a mechanism (not shown). When the feed roller 9 is rotated, the sheets 4 are pinched between the separation roller 10 and the separation pad 11 and then separated one by one. The sheet 4 passed between the separation roller 10 and the separation pad 11 is transported to a registration roller 13 by a pair of transport rollers 12. The registration roller 13 transports the sheet 4 onto a belt unit 15 which is provided on the rear side of the registration roller 13 at a predetermined timing.

The belt unit 15 is detachable from the body casing 2 and includes a transport belt 18 which is horizontally wound around a pair of belt supporting rollers 16 and 17 separated from each other in the front-rear direction. The transport belt 18 is an endless belt made of a resin material, such as polycarbonate. When the rear belt supporting roller 17 is rotated, the transport belt 18 is rotated in the clockwise direction of FIG. 1 to transport the sheet loaded on the upper surface thereof to the rear side. Four transfer rollers 19 are provided along a line inside the transport belt 18 at a predetermined interval in the front-rear direction so as to oppose photosensitive drums 31 of an image forming unit 26, which will be described below. The belt 18 is interposed between the photosensitive drums 31 and the corresponding transfer rollers 19.

A scanner unit 20 is provided at an upper part in the body casing 2. A process unit 25 (an example of an image forming unit), is provided below the scanner unit 25. The belt unit 15 is provided below the process unit 25. The scanner unit 20 emits laser beams L for respective colors onto the surfaces of the photosensitive drums 31 based on image data to perform high-speed scanning on the photosensitive drums 31. The configuration of the scanner unit 20 will be described in detail below.

The process unit 25 includes four image forming units 26 corresponding to black (K), cyan (C), magenta (M), and yellow (Y), and the image forming units 26 are arranged in a line in the front-rear direction. In this exemplary embodiment, the black, yellow, magenta, and cyan image forming units 26 are arranged in a line in this order from the front surface of the laser printer 1. Each of the image forming units 26 includes the photosensitive drum 31, a scorotron charging unit 32, and a developing cartridge 34 and the like.

The photosensitive drum 31 includes a metal drum body connected to the ground and a positively chargeable photosensitive layer made of polycarbonate is coated on the outer surface of the drum body. The photosensitive drum 31 is capable of carrying developer on the outer surface thereof. The scorotron charging unit 32 is obliquely provided on the upper rear side of the photosensitive drum 31, and is arranged to oppose the photosensitive drum 31 with a predetermined gap therebetween so as not to come into contact with the photosensitive drum 31. The scorotron charging unit 32 uniformly charges the surface of the photosensitive drum 31 to a positive potential by generating a corona discharge from a charging wire made of tungsten or the like.

The developing cartridge 34 has a substantially box shape. A toner container 38 is provided at an upper part of the developing cartridge 34. A supply roller 39, a developing roller 40, and a layer thickness regulating blade 41 are provided below the toner container 38. Black, cyan, magenta, and yellow toner which are positively chargeable non-magnetic one component toner are accommodated as a developer in the toner containers 38, respectively. Further, an agitator 42 for agitating toner is provided in each of the toner containers 38.

The supply roller 39 includes a metal roller shaft and a conductive foam material coating the roller shaft. The developing roller 40 includes a metal roller shaft and a conductive rubber material coating the roller shaft. The toner discharged from the toner container 38 is supplied to the developing roller 40 by the rotation of the supply roller 39, and is then positively charged by the friction between the supply roller 39 and the developing roller 40. The toner supplied to the developing roller 40 enters between the layer thickness regulating blade 41 and the developing roller 40 with the rotation of the developing roller 40, so that the toner is sufficiently frictionally charged therebetween and is carried onto the developing roller 40 as a thin layer having a constant thickness.

The surface of the photosensitive drum 31 is uniformly charged to a positive potential by the scorotron charging unit 32 while being rotated. Then, the scanner unit (an example of an exposure unit) 20 emits the laser beam L to the surface of photosensitive drum 31 to perform high-speed scan, thereby forming an electrostatic latent image corresponding to an image to be formed on the sheet 4. Then, when the positively charged toner carried on the developing roller 40 faces and comes into contact with the photosensitive drum 31 by the rotation of the developing roller 40, the toner is supplied to the electrostatic latent image formed on the surface of the photosensitive drum 31. Accordingly, toner is attached to an exposed portion of the surface of the photosensitive drum 31 to form a toner image (developer image), that is, the electrostatic latent image on the photosensitive drum 31 is visualized.

Then, the toner images formed on the surfaces of the photosensitive drums 31 are sequentially transferred onto the sheet 4 transported by the transport belt 18 by a transfer current that flows from the photosensitive drums 31 to the transfer rollers 19 by a constant current control method, when the sheet 4 passes between the photosensitive drums 31 and the transfer rollers 19. Then, the sheet 4 having the toner images transferred thereto is transported to a fixing device 43 (an example of a fixing unit).

The fixing device 43 is provided on the rear side of the transport belt 18 in the body casing 2. The fixing device 43 includes a heating roller 44 and a pressure roller 45. The heating roller 44 has a heat source, such as a halogen lamp, and is rotated. The pressure roller 45 is provided below the heating roller 44 so as to oppose the heating roller 44 and presses the heating roller 44. And, the pressure roller 45 is rotated along the rotation of the heating roller 44. In the fixing device 43, the sheet 4 having four color toner images formed thereon is heated while being pinched and transported by the heating roller 44 and the pressure roller 45. Accordingly, the fixing device 43 thermally fixes the toner images onto the sheet 4. Then, the sheet 4 having the toner images thermally fixed thereto is pinched between a discharge roller 46 and two pinch rollers 47 that are obliquely provided on the upper rear side of the fixing device 43, and the curling of the sheet 4 is removed. Then, the sheet 4 is transported and pinched between a final discharge roller 48 and two pinch rollers 49 that are provided at an upper part of the body casing 2, and the curling of the sheet is further removed. Then, the sheet is discharged to the discharge tray 5.

The scanner unit 20 includes a box-shaped housing 50 made of resin. A polygon mirror 52 such as a hexagonal mirror is rotatably provided substantially at the center in the housing and is driven by a polygon motor 51. In the housing 50, four laser beam sources (not shown) are provided around the right side of the polygon mirror 52 as follows.

A laser beam source which emits a laser beam Lk according to black image data faces one inclined plane of the polygon mirror 52 which is slightly inclined downward. The laser beam Lk deflected from the inclined plane of the polygon mirror 52 is guided to the front surface of the laser printer 1 and passes through a first scanning lens 53 such as an fθ lens. Then, the laser beam Lk is reflected from reflecting mirrors 54 and 55 and passes through a second scanning lens 56 such as a toric lens. Then, the laser beam is incident on the surface of the first photosensitive drum 31 from the front side.

A laser beam source which emits a laser beam Ly according to yellow image data faces one inclined plane (the same inclined plane as described above) of the polygon mirror 52 which is slightly inclined upward. The laser beam Ly deflected from the inclined plane of the polygon mirror 52 is guided to the front surface of the laser printer 1 and passes through the first scanning lens 53. Then, the laser beam Ly is reflected from reflecting mirrors 57, 58 and 59 and passes through the second scanning lens 60. Then, the laser beam is incident on the surface of the second photosensitive drum 31 from the front side.

A laser beam source which emits a laser beam Lm according to magenta faces one inclined plane (which is adjacent to the above-mentioned inclined plane) of the polygon mirror 52 which is slightly inclined downward. The laser beam Lm deflected from the inclined plane of the polygon mirror 52 is guided to the rear surface of the laser printer 1 and passes through a first scanning lens 61. Then, the laser beam Lm is reflected from reflecting mirrors 62, 63 and 64 and passes through a second scanning lens 65. Then, the laser beam is incident on the surface of the third photosensitive drum 31 from the front side.

A laser beam source which emits a laser beam Lc according to cyan faces one inclined plane (the same inclined plane as that by which the magenta laser beam is deflected) of the polygon mirror 52 which is slightly inclined upward. The laser beam Lc deflected from the inclined plane of the polygon mirror 52 is guided to the rear surface of the laser printer 1 and passes through the first scanning lens 61. Then, the laser beam Lc is reflected from reflecting mirrors 66 and 67 and passes through a second scanning lens 68. Then, the laser beam is incident on the surface of the last photosensitive drum 31 from the front side. It is noted that JP-A-2007-253480 discloses the scanner unit 20 having the above-described configuration, for example.

The discharge roller 46 is configured to be rotatable forward and backward. A re-transport mechanism 70 (an example of a re-transport unit) is provided on the lower surface of the sheet feed cassette 7. The re-transport mechanism 70 transports to the transport roller 12 the sheet 4 along a path represented by a two-dot chain line in FIG. 1 when the discharge roller 46 is rotated backward. The re-transport mechanism 70 includes a re-transport path 71 which extends in the front-rear direction along the lower surface of the sheet feed cassette 7 and a first chute 72 which guides the sheet 4 transported downward by the discharge roller 46 to the re-transport path 71. A plurality of sets of re-transport rollers 73 which are rotated while contacting the sheet 4 to transport the sheet 4 forward are provided along the re-transport path 71. A second chute 74 which guides the sheet 4 transported to the front end of the re-transport path 71 by the re-transport rollers 73, to the transport roller 12 is provided at the front end of the re-transport mechanism 70.

Accordingly, double-side printing can be performed which forms an image on a first surface of the sheet 4 by the process unit 25, transport the sheet 4 until the rear end of the sheet 4 is pinched between the discharge roller 46 and the two pinch rollers 47. Then, the discharge roller 46 is rotated backward to discharge and transports the sheet 4 to the transport roller 12 using the re-transport mechanism 70. Thereafter, the process unit 25 forms another image on a second face of the sheet 4.

(Configuration of Blowing Device)

Figure 2:
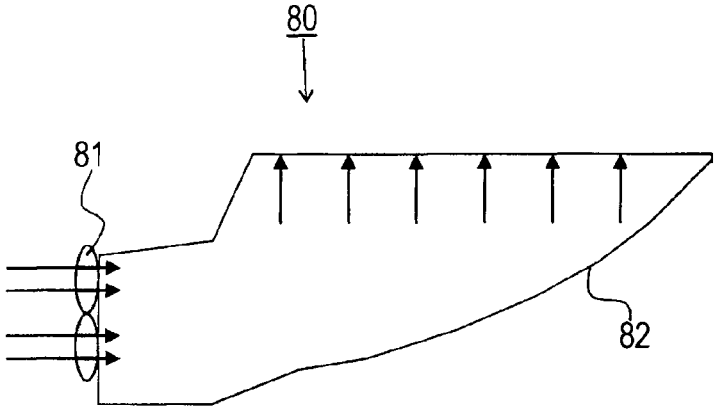
FIG. 2 is a transverse cross-sectional view schematically illustrating a blowing device of the laser printer.

A blowing device 80 (an example of a cooling unit) is provided on the downstream side of the fixing device 43 in the direction in which the sheet is transported. The blowing device 80 is configured to cool the sheet 4 having an image thermally fixed thereto. FIG. 2 is a transverse cross-sectional view schematically illustrating the blowing device 80. As shown in FIG. 2, the blowing device 80 includes a fan 81 provided on one side thereof and a duct 82 which guides the air blown by the fan 81. As shown in FIG. 1, the duct 82 includes an opening portion 82A which is provided close to the fixing device 43 at the downstream side in the direction in which the sheet is transported. The opening portion 82A is formed at a position which does not overlap a sheet re-transport path of the sheet 4 from the heating roller 44 to the pinch rollers 47.

Therefore, the sheet 4 immediately after passing though the fixing device 43 is cooled by drive the fan 81 to blow air to the sheet 4. Accordingly, it is possible to effectively reduce or prevent the sheet 4 from being thermally dried. Additionally, when the discharge roller 46 is rotated backward to transport the sheet 4 to the re-transport mechanism 70, the sheet 4 passes through the rear side of the duct 82 and is then transported to the re-transport mechanism 70.

Figure 3:
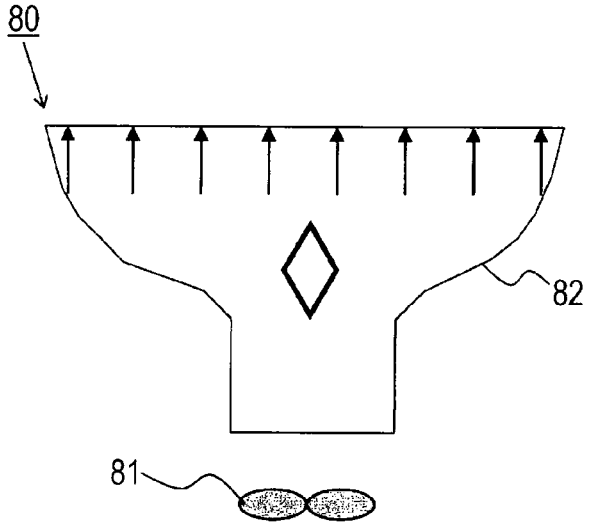
FIG. 3 is a transverse cross-sectional view schematically illustrating a modified example of the blowing device.

In FIG. 2, the fan 81 is provided on the side of the duct 82. However, as shown in FIG. 3, according to a modified example, the fan 81 may be provided below the duct 82 or the rear side of the duct 82. The fan 81 according to the exemplary embodiment has a plurality of fins and a fan motor 85 which rotates the fins to generate blowing air. Since the amount of blowing air is proportional the rotation speed of the fins of the fan 81, the amount of blowing air can be controlled by adjusting the rotation speed of the fan motor 85. A type of the fan 81 may be any as long as it can control the amount of blowing air. For example, the fan 81 may be an axial fan or a sirocco fan.

(Configuration and Process of Control System)

Figure 4:
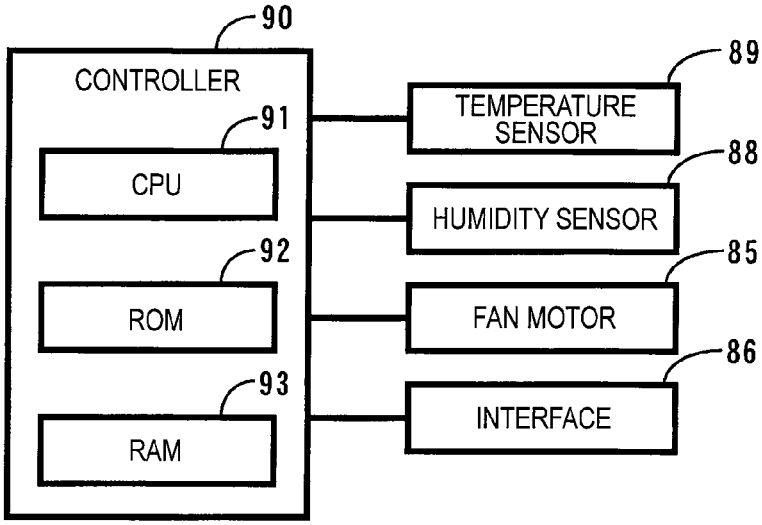
FIG. 4 is a block diagram illustrating the configuration of a control system of the laser printer.

FIG. 4 is a block diagram illustrating the configuration of a control system of the laser printer 1. As shown in FIG. 4, a controller 90 is connected with the fan motor 85 for driving the fan 81, an interface 86 to which the image data is input, and a humidity sensor 88 and a temperature sensor 89. It is noted that although the polygon motor 51 and the like are connected to the controller 90, actually, they are not shown in FIG. 4 since the polygon mirror 51 and the like are not directly related to a main portion of the following process.

Figure 5:
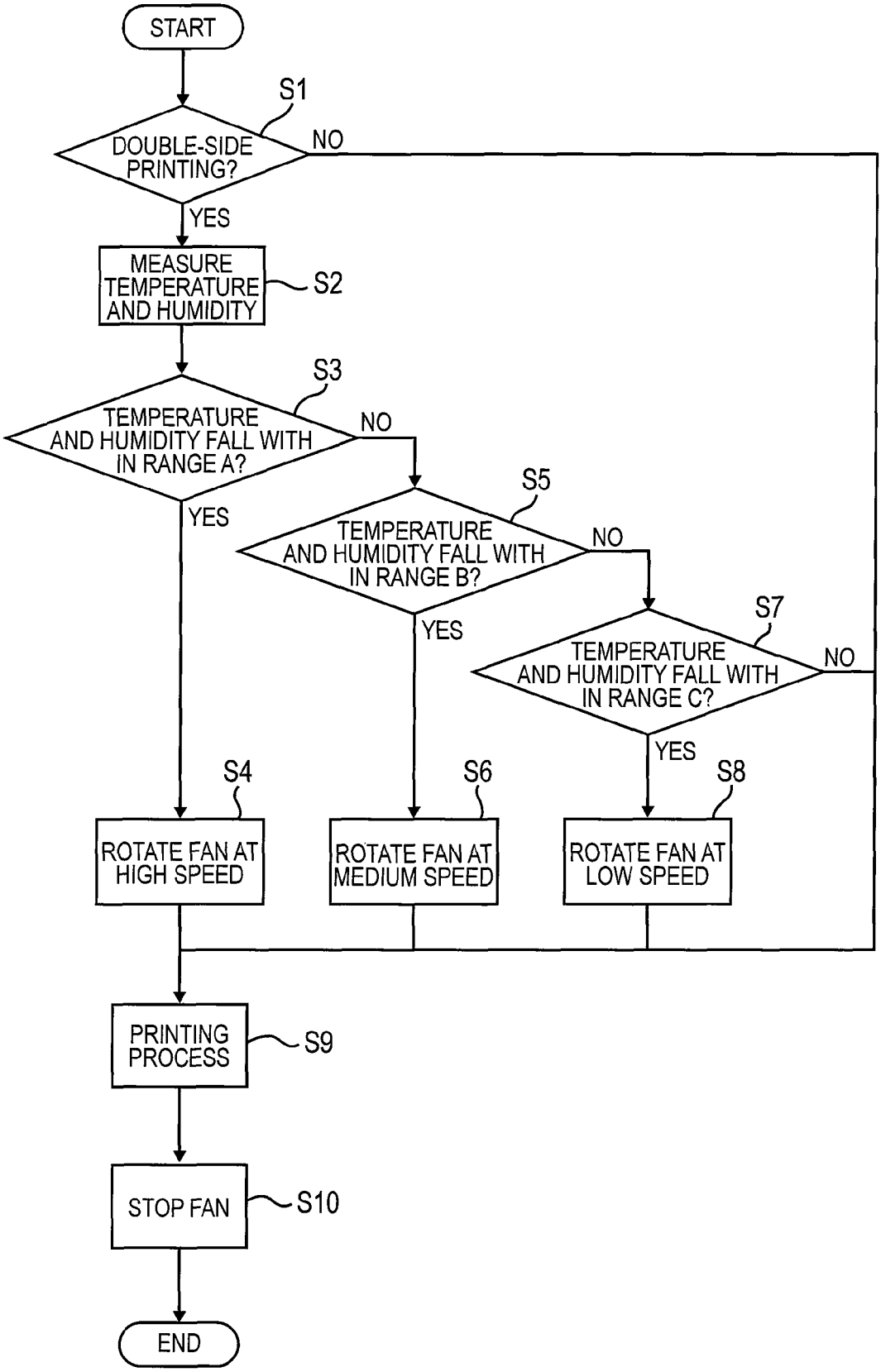
FIG. 5 is a flowchart illustrating a process performed by the control system.

The controller 90 is a microcomputer including a Central Processing Unit (CPU) 91, a Read Only Memory (ROM) 92, and a Random Access Memory (RAM) 93, and performs the following process based on a program stored in the ROM 92. FIG. 5 is a flowchart illustrating the process performed by the controller 90 when image data including print setting data and he like is input to the interface 86.

As shown in FIG. 5, in the process, first Step S1, it is determined whether the double-side printing is instructed, based on, for example, the print setting of the image data. If it is determined that the double-side printing is instructed (S1: Yes), the temperature sensor 89 and the humidity sensor 88 measure a temperature and a humidity at an environment in which the laser printer 1 is installed at Step S2.

Figure 6:
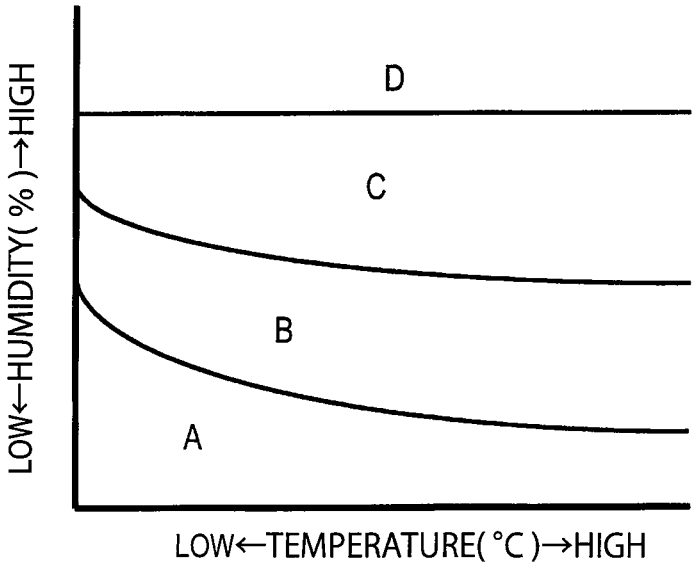
FIG. 6 is a diagram illustrating an example of a two-dimensional map used in the process of FIG. 5.

Then, it is determined which one of ranges A, B, C and D, a combination of the temperature and the humidity measured at Step S2 falls within through Steps S3, S5 and S7. The inventors of the present invention has found that the electric resistance value is divided into four ranges A, B, C and D when the electric resistance value is measured while varying the temperature and the humidity as shown in the two-dimensional map of FIG. 6, in which a vertical axis represents the humidity and a horizontal axis represents the temperature. The electric resistance value of the ranges A, B, C and D are lowered in this order. At Steps S3 to S8 described later, based on this find, the control of the fan 81 suitable to the electric resistance value of the sheet 4 is realized without directly measuring the electric resistance value, by determining which one of the ranges A, B, C and D, the combination of the temperature and the humidity determined at Step S2 falls within.

Specifically, if it is determined that the combination of the temperature and the humidity measured at Step S2 falls within the range A (S3: Yes), the fan motor 85 is driven to rotate the fins of the fan 81 at a high speed (first speed) at Step S4, and the process proceeds to a printing process at Step S9, which will be described below. If it is determined that the combination of the temperature and the humidity measured at Step S2 falls within the range B (S3: No, S5: Yes), the fan motor 85 is driven to rotate the fins of the fan 81 at a medium speed (second speed) at Step S6. If it is determined that the combination of the temperature and the humidity measured at Step S2 falls within the range C (S3: No, S5: No, S7: Yes), the fan motor 85 is driven to rotate the fins of the fan 81 at a low speed (third speed) at Step S8. If the combination of the temperature and the humidity measured at Step S2 does not fall within any ranges A, B and C (S3: No, S5: No, S7: No), the combination is regarded as falling within the range D, and the process proceeds to the printing process at Step S9 without driving the fan motor 85. On the other hand, at Step S1, if it is determined that the double-side printing is not instructed (S1: No), the process proceeds to the printing process at Step S9 directly from the step S1. Therefore, the fan motor 85 is not driven in this case also.

In the printing process at Step S9, know printing process is performed according to the input image data by the process unit 25. Upon the printing process finishes, the rotation of the fan 81 is stopped at Step 10. Then the process of FIG. 5 ends. In this exemplary embodiment, during the printing process at Step S9, the rotation speed of the fan 81 is maintained constant. However, the fan 81 may be rotated only when the sheet 4 passes the opening portion 82A and stopped when the sheet 4 does not pass the opening portion 82A.

Effects of this Exemplary Embodiment and Modified Examples

As described above, in this exemplary embodiment, as the electric resistance value of the sheet 4 corresponding to the temperature and the humidity measured by the temperature sensor 89 and the humidity sensor 88 is increased, the rotation speed of the fan 81 is increased to improve the cooling effect. Therefore, as the electric resistance value is increased, the cooling effect of the sheet 4 is increased to reduce or prevent a further increase in the electric resistance value. Accordingly, it is possible to effectively reduce or prevent a variation in the electric resistance value of the sheet 4, and thus form a high-quality image on the second surface. Additionally, since the fan 81 is not driven at inappropriate time, it is possible to reduce power consumption and noise sound. Since the temperature sensor 89 or the humidity sensor 88 can be easily provided to the laser printer 1 and can also be mounted to the existing laser printer, it is possible to reduce the manufacturing costs of the apparatus. In this exemplary embodiment, the temperature of the environment in which the laser printer 1 is installed is measured. However, the temperature of the sheet 4 may be measured by providing the temperature sensor in the proximity of the sheet 4 accommodated in the sheet feed cassette 7.

While the present invention has been shown and described with reference to certain exemplary embodiments thereof, it will be understood by those skilled in the art that various changes in form and details may be made therein without departing from the spirit and scope of the invention as defined by the appended claims.

For example, the following various configuration and combinations thereof may be used for controlling the cooling unit.

Figure 7:
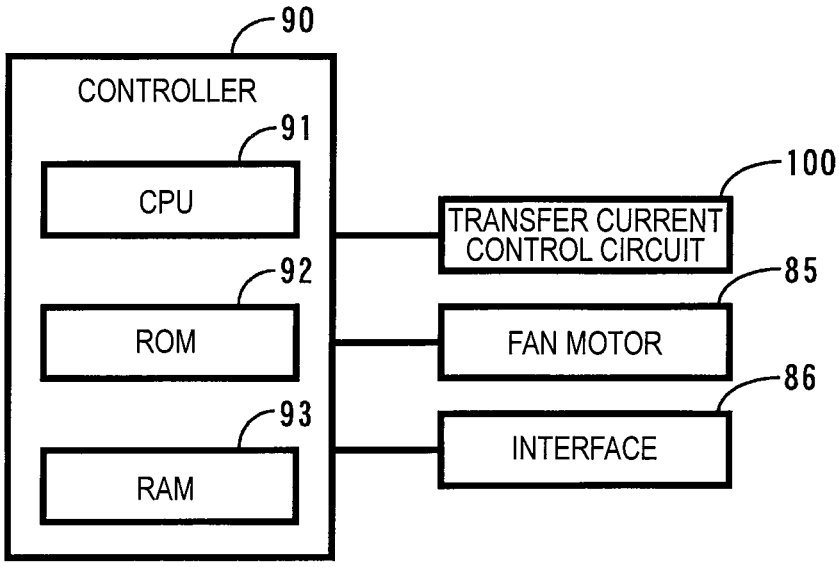
FIG. 7 is a block diagram illustrating the configuration of a modified example of the control system.
Figure 8:
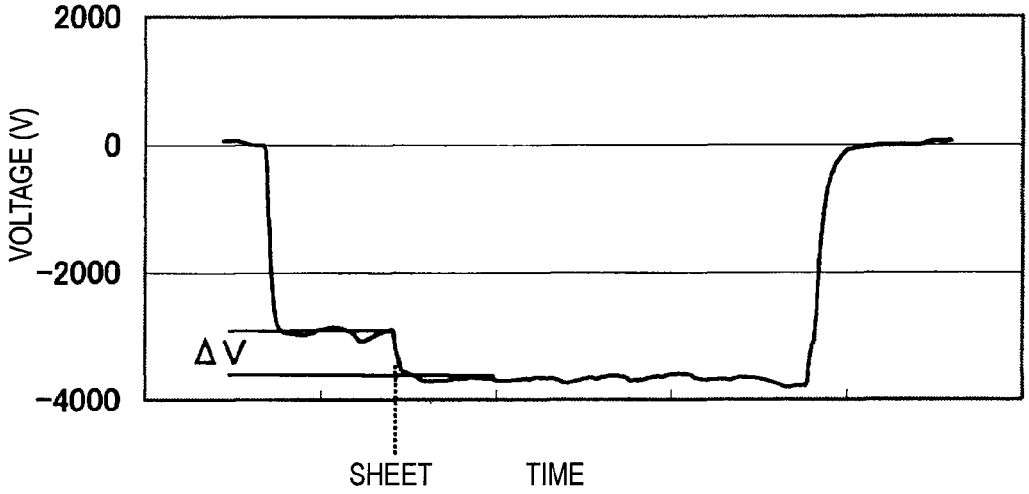
FIG. 8 is a diagram illustrating an example of a variation in a transfer voltage in the control system.

As described above, a transfer current is flowed under constant current control. As shown in FIG. 7, instead of the humidity sensor 88 and the temperature sensor 89, a transfer current control circuit 100 which performs constant current control on the transfer current may be connected to the controller 90. FIG. 8 is a diagram illustrating a variation in the output voltage (transfer voltage) of the transfer current control circuit 100. As shown in FIG. 8, when the sheet 4 is pinched between the photosensitive drum 31 and the transfer roller 19 at the timing indicated by a dotted line, the transfer voltage is rapidly decreased. In this case, a changed amount $\Delta V$ is affected by the electric resistance value of the sheet 4.

Accordingly, it can be considered that the fan 81 is controlled based on the changed amount $\Delta V$, as described above. In this case, at Step S2, instead of the humidity and the temperature, the changed amount $\Delta V$ may be measured, and an electric resistance value range corresponding to the changed amount $\Delta V$ may be determined similarly to Steps S3, S5 and S7. In this case, it is possible to perform the above-described control process using the signals of the existing transfer current control circuit 100, without adding a new sensor. When the transfer current is under constant voltage control, a transfer current value may be measured instead of the transfer voltage to estimate the electric resistance value of the sheet 4. It is noted that, the electric resistance value of the sheet 4 may be actually calculated based on a voltage applied between the photosensitive drum 31 and the transfer roller 19 and an electric current flowing between the photosensitive drum 31 and the transfer roller 19.

Figure 9:
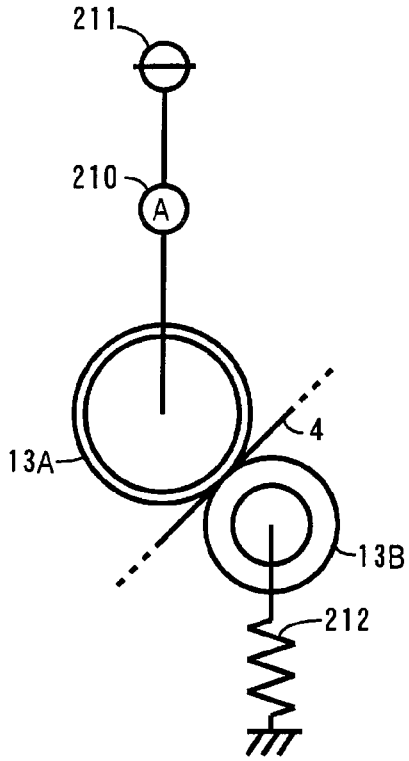
FIG. 9 is a diagram schematically illustrating the configuration which directly measures an electric resistance value of a sheet.

As shown in FIG. 9, a pair of rollers 13A and 13B of the registration roller 13 may be made of a conductive material. The roller 13A may be connected to a DC power supply 211 through an ammeter 210, and the roller 13B may be connected to the ground through a resistor 212. In this case, a current value measured by the ammeter 210 varies depending on the electric resistance value of the sheet 4 pinched between the rollers 13A and 13B. In this case, at Step S2, instead of the temperature and the humidity, a current value may be measured by the ammeter 210, and an electric resistance value range corresponding to the current value may be determined similarly to Steps S3, S5 and S7. In this case, since the electric resistance value of the sheet 4 is directly measured, it is possible to more appropriately control the rotation speed of the fan 81. Additionally, in this case, it is possible to measure a difference in electric resistance value due to the kind of sheets 4. It is noted that, the electric resistance value of the sheet 4 may be actually calculated based on a voltage applied between the pair of rollers 13A and 13B and an electric current flowing between the pair of rollers 13A and 13B.

In the case of calculating the electric resistance value of the sheet 4 by using an applied voltage and a flowing current between the sheet 4 as described above, the rotation speed of the fan 81 may be controlled continuously according to the calculated electric resistance of the sheet 4.

Figure 10:
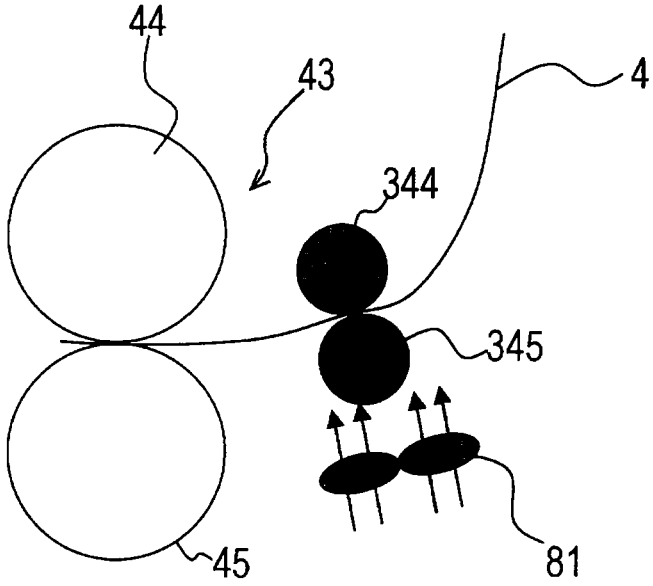
FIG. 10 is a diagram schematically illustrating the configuration of a modified example of the blowing device.

Additionally, configuration other than the fan 81 may be used as the cooling unit. When the fan 81 is used, as shown in FIG. 10, the fan 81 may blow air to the sheet 4 which is passing through the fixing device 43 and is then pinched between transport rollers 344 and 345 provided at the downstream side of the fixing device 43. However, in this case, it may be preferable that the transport roller 344 opposite to the fan 81 be made of, for example, sponge rubber and the transport roller 345 on the side of the fan 81 be made of, for example, metal or hard rubber having high heat conductivity. In this case, it may be preferable that, in a single-sided printing mode (S1: No), the fan 81 be controlled by the same method as that in a double-side printing mode (S1: Yes), in order to reduce or prevent an increase in the temperature of the transport rollers 344 and 345. In addition, the transfer unit applying the transfer current is not limited to a roller type, such as the transfer roller 19, but a corotron-type transfer unit may be used.

Further, the fan 81 may be controlled by a simple on/off switching method. However, as in the above-described embodiment, when the cooling effect by the fan 81 is divided into a plurality of levels, it is possible to more finely control the cooling effect. Therefore, it is possible to form a high-quality image on the second surface. Further, the present invention can be applied to various image forming apparatuses, such as an intermediate transfer color laser printer, a four-cycle color laser printer, and a monochrome laser printer, as well as the direct tandem color laser printer. Furthermore, a two-component developing method as well as a one-component developing method may be used as a developing method. In addition, the function of the re-transport unit is not limited for a double-side printing function, but the re-transport unit may have a function of printing images on the same surface of the sheet 4 a plurality of times such that the images overlap each other.

Further, according to the above-described exemplary embodiment, the scanner unit 20 performs fast-speed scan on the photosensitive drums 31 by using the polygon mirror 52. However, the scanner unit may include LED arrays which are provided to oppose the photosensitive drums 31, respectively. Each of the LED arrays emits light to expose the corresponding photosensitive drum 31 according to image data.

What is claimed is:

1. An electrophotographic image forming apparatus comprising:

an image forming unit configured to form an image on a recording medium;

a fixing unit configured to fix the image onto the recording medium by applying heat and pressure;

a re-transport unit configured to re-transport the recording medium which has passed through the fixing unit, to the image forming unit along a re-transport path;

a cooling unit provided between the fixing unit and the image forming unit along the re-transport path and comprising a fan configured to rotate by a rotation speed to generate blowing air to cool the recording medium transported by the re-transport unit, wherein an amount of the blowing air generated varies according to the rotation speed;

a parameter signal output unit comprising a temperature sensor and a humidity sensor, wherein the parameter signal output unit is configured to output a signal corresponding to a parameter for controlling the cooling unit, the signal corresponding to a temperature measured by the temperature sensor and a humidity measured by the humidity sensor; and a controller configured to control the rotation speed of the cooling unit fan according to the signal output from the parameter signal output unit, wherein the controller is configured to vary the rotation speed of the fan between: a first rotation speed, a second rotation speed smaller than the first rotation speed, a third rotation speed smaller than the second rotation speed, and zero, wherein the controller is configured to control the fan to a faster rotation speed as the humidity corresponding to the signal output from the parameter signal output unit becomes lower.

2. The image forming apparatus according to claim 1, further comprising a medium accommodating unit which accommodates a recording medium on which an image is to be formed by the image forming unit, wherein the temperature sensor and the humidity sensor are provided in proximity to the recording medium accommodated in the medium accommodating unit.

3. The image forming apparatus according to claim 1, wherein the controller controls the fan to rotate at the first rotation speed if a combination of the temperature and the humidity corresponding to the signal output from the parameter signal output unit is within a first range, wherein the controller controls the fan to rotate at the second rotation speed if the combination of the temperature and the humidity corresponding to the signal output from the parameter signal output unit is within a second range, wherein the controller controls the fan to rotate at the third rotation speed if the combination of the temperature and the humidity corresponding to the signal output from the parameter signal output unit is within a third range, and wherein the controller controls the fan to not rotate if the combination of the temperature and the humidity corresponding to the signal output from the parameter signal output unit is not within any of the first, second and third ranges.

4. The image forming apparatus according to claim 3, wherein a boundary between the first range and the second range is defined by a first humidity threshold that decreases as temperature increases and by a first boundary gradient that decreases as temperature increases, wherein a boundary between the second range and the third range is defined by a second humidity threshold greater than the first humidity threshold, wherein the second humidity threshold decreases as the temperature increases and has a second boundary gradient that decreases as temperature increases, wherein a boundary between the third range and a fourth range is defined by a third humidity threshold that remains substantially constant as temperature increases, the third humidity threshold being higher than the first humidity threshold and the second humidity threshold, and wherein the controller is configured to control the fan to not rotate in the fourth range.

5. The image forming apparatus according to claim 1, wherein the image forming unit comprises:

a photosensitive drum capable of carrying developer on a surface thereof;

a charging unit configured to charge the surface of the photosensitive drum;

an exposure unit configured to expose the surface of the photosensitive drum to form an electrostatic latent image thereon;

a developing roller configured to supply developer to the electrostatic latent image to form a developer image; and a transfer roller configured to cause the developer image to be transferred from the surface of the photosensitive drum to the recording medium, and wherein the parameter signal output unit is configured to measure an electric resistance value of the recording medium as the parameter and to output a signal corresponding to the measured electric resistance.

6. The image forming apparatus according to claim 5, wherein the parameter signal output unit is configured to measure the electric resistance of the recording medium based on a voltage applied between the photosensitive drum and the transfer roller, and an electric current flowing between the photosensitive drum and the transfer roller.

7. The image forming apparatus according to claim 5, wherein the image forming unit further comprises:

a pair of registration rollers between which the recording medium passes; and a voltage applying unit configured to apply a voltage between the pair of registration rollers, and wherein the parameter signal output unit is configured to measure the electric resistance of the recording medium based on the voltage applied between the pair of registration rollers and an electric current flowing between the pair of registration rollers.

8. The image forming apparatus according to claim 1, wherein the image forming unit comprises:

a photosensitive drum capable of carrying developer on a surface thereof;

a charging unit configured to charge the surface of the photosensitive drum;

an exposure unit configured to expose the surface of the photosensitive drum to form an electrostatic latent image thereon;

a developing roller configured to supply developer to the electrostatic latent image to form a developer image;

a transfer roller configured to cause the developer image to be transferred from the surface of the photosensitive drum to the recording medium; and a transfer current control unit configured to control a transfer current between the transfer roller and the photosensitive drum to be constant, and wherein the parameter signal output unit is configured to measure a voltage between the transfer roller and the photosensitive drum as the parameter and to output a signal corresponding to the measured voltage.

* * * * *